US007421989B2

(12) United States Patent
Fischer et al.

(10) Patent No.: US 7,421,989 B2
(45) Date of Patent: Sep. 9, 2008

(54) VANE-TYPE CAM PHASER HAVING INCREASED ROTATIONAL AUTHORITY, INTERMEDIATE POSITION LOCKING, AND DEDICATED OIL SUPPLY

(75) Inventors: Thomas H. Fischer, Rochester, NY (US); Daniel R. Cuatt, Rush, NY (US)

(73) Assignee: Delphi Technologies, Inc., Troy, MI (US)

( * ) Notice: Subject to any disclaimer, the term of this patent is extended or adjusted under 35 U.S.C. 154(b) by 70 days.

(21) Appl. No.: 11/225,772

(22) Filed: Sep. 13, 2005

(65) Prior Publication Data

US 2007/0056539 A1 Mar. 15, 2007

(51) Int. Cl.
*F01L 1/34* (2006.01)

(52) U.S. Cl. ..... 123/90.17; 123/90.15; 123/90.31; 92/122

(58) Field of Classification Search ..... 123/90.17
See application file for complete search history.

(56) References Cited

U.S. PATENT DOCUMENTS

| | | | | |
|---|---|---|---|---|
| 5,823,152 | A | 10/1998 | Ushida | |
| 5,865,151 | A | 2/1999 | Fukaya | |
| 5,960,757 | A | 10/1999 | Ushida | |
| 6,006,709 | A | 12/1999 | Ushida | |
| 6,155,221 | A | 12/2000 | Ushida | |
| 6,176,210 | B1 | 1/2001 | Lichti et al. | |
| 6,199,524 | B1 | 3/2001 | Ushida | |
| 6,202,610 | B1 | 3/2001 | Yoshiki et al. | |
| 6,276,321 | B1 | 8/2001 | Lichti et al. | |
| 6,318,319 | B1 * | 11/2001 | Miyasaka et al. | 123/90.17 |
| 6,655,332 | B2 * | 12/2003 | Takenaka et al. | 123/90.17 |
| 6,675,752 | B1 * | 1/2004 | Kunne et al. | 123/90.17 |

(Continued)

FOREIGN PATENT DOCUMENTS

| | | |
|---|---|---|
| DE | 102 53 883 | 5/2004 |

(Continued)

OTHER PUBLICATIONS

European Search Report for European Patent Application No. 06 076 655.7-2311 dated Jan. 22, 2007.

(Continued)

*Primary Examiner*—Thomas Denion
*Assistant Examiner*—Kyle M Riddle
(74) *Attorney, Agent, or Firm*—Michael D. Smith

(57) ABSTRACT

A vane-type camshaft phaser having a rotational authority between 40 crank degrees before TDC and 30 crank degrees after TDC. The phaser includes a stator seat formed at a rotation position intermediate between full advance and full retard. A locking pin in a vane of the rotor engages the seat, locking the rotor at the intermediate position. The pin is disengaged by pressurized engine oil independent of oil flows for advance and retard of the rotor. The oil is controlled by a dedicated valve. Preferably, the seat and the ends of the locking pin are vented by passages in the rotor and stator which are aligned when the rotor is at the selected locking angle to remove oil resistance to entry of the pin into the seat. To position the locking pin over the seat, phasing rate is reduced to allow time for the locking pin to engage the seat.

13 Claims, 8 Drawing Sheets

U.S. PATENT DOCUMENTS

| | | | | |
|---|---|---|---|---|
| 6,758,179 | B1 | 7/2004 | McKay et al. | |
| 6,814,038 | B2 * | 11/2004 | Smith | 123/90.17 |
| 6,848,401 | B2 * | 2/2005 | Takenaka et al. | 123/90.15 |
| 6,941,913 | B2 * | 9/2005 | Smith | 123/90.17 |
| 6,997,151 | B2 * | 2/2006 | Axmacher et al. | 123/90.17 |
| 2001/0042528 | A1 | 11/2001 | Shunicki | |
| 2005/0132991 | A1 * | 6/2005 | Knecht et al. | 123/90.17 |

FOREIGN PATENT DOCUMENTS

| | | | |
|---|---|---|---|
| EP | 0 799 977 | A1 | 10/1997 |
| EP | 0 881 364 | A1 | 12/1998 |
| EP | 1 178 184 | | 2/2002 |
| EP | 1 201 885 | A1 | 5/2002 |
| EP | 1 355 047 | | 10/2003 |
| EP | 1 371 818 | A | 12/2003 |
| EP | 1 589 196 | A | 10/2005 |

OTHER PUBLICATIONS

EP Search Report dated Apr. 25, 2007.

* cited by examiner

VANE-TYPE CAM PHASER HAVING INCREASED ROTATIONAL AUTHORITY, INTERMEDIATE POSITION LOCKING, AND DEDICATED OIL SUPPLY

TECHNICAL FIELD

The present invention relates to vane-type camshaft phasers for varying the phase relationship between crankshafts and camshafts in internal combustion engines; more particularly, to such phasers wherein a locking pin assembly is utilized to lock the phaser rotor with respect to the stator at certain times in the operating cycle; and most particularly, to a phaser having means for locking a phaser rotor at a rotational position intermediate between full phaser advance and full phaser retard positions, wherein the phaser has an expanded range of retard action and the locking pin is controlled by a dedicated oil supply.

BACKGROUND OF THE INVENTION

Camshaft phasers for varying the phase relationship between the crankshaft and a camshaft of an internal combustion engine are well known. In a typical prior art vane-type cam phaser, a controllably variable locking pin is slidingly disposed in a bore in a rotor vane to permit rotational locking of the rotor to the stator under certain conditions of operation of the phaser and engine.

A known locking pin mechanism includes a return spring to urge an end of the pin slidably mounted in a rotor into a hardened seat disposed in the stator of the phaser, thus locking the rotor with respect to the stator. In operation, the pin is forced from the seat to unlock the rotor from the stator by pressurized oil supplied from a control valve, overcoming the seating spring, in response to a programmed engine control module (ECM). The oil may be applied to the end of the pin and/or to the underside of a pin shoulder via passages formed in the rotor and/or the pulley/sprocket.

A prior art vane-type phaser generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve (OCV), in accordance with an engine control module, to either the advance or retard chambers, to change the angular position of the rotor relative to the stator, as required to meet current or anticipated engine operating conditions. As used herein, the advance chambers are referred to as C1 and the retard chambers are referred to as C2. Thus, the corresponding actuating oil pressures are referred to as C1 oil and C2 oil.

In a typical prior art phaser, engagement or disengagement of the locking pin is tied to C1 or C2 oil pressure. That is, the pin is locked or unlocked, via appropriate porting, by the same oil supply that drives either the advance or retard of the phaser.

A problem in such prior art phasers is that the pressure requirements and timing of advance and retard can be quite different than those for pin movement under some engine operating conditions. It is well known in the art, for example, that a locking pin may become stuck in lock mode when chamber pressure increases faster than the pin can respond, causing the rotor to try to rotate before the locking pin is fully retracted, thereby binding the pin in the locking seat. Further, oil pressures may be too low to reliably actuate the locking pin, even when the rotor is properly actuated.

A problem in some prior art phasers is that re-engagement of the pin end with the stator seat can be uncertain. If the pin and seat are both cylindrical, near-perfect registration is required, plus a finite period of registration, for the pin to enter the seat. If the pin fails to fully engage the seat, the pin can be forced out of the seat during engine operation when locking engagement is required, which is highly undesirable.

To overcome this problem, it is known in the art to bevel, chamfer, or taper the pin to assist in its entry into the seat. See, for example, U.S. Pat. No. 5,865,151. However, such a non-cylindrical pin can be forced from the seat by pressure fluctuations in the phaser advance and retard chambers caused by torque reversals imposed on the camshaft during valve opening and closing events. To overcome this problem, it is known to axially offset the pin axis from the seat axis. In prior art phasers, the locking position of the rotor is typically in full valve-retard mode, wherein at least one rotor vane is in mechanical contact with a lobe of the stator. The offset pin acts to wedge the rotor firmly against the stator such that the rotor position cannot fluctuate under torque reversals imposed on the camshaft. This offset pin design is known in the art as a "negative gap".

In prior art intake valve phasers, the rotational range of phaser authority is typically about 50 degrees; that is, from a piston top-dead-center (TDC) position, the valve timing may be advanced to a maximum of about −40 degrees and retarded to a maximum of about +10 degrees. Because the rotor is stopped by the stator, further advance or retard, should it be desired under special circumstances, is not possible in a prior art phaser. Further, a prior art phaser is not adapted for rotor-locking an intermediate authority position, as would be required.

Surprisingly, in certain situations such as, for example, for engines having intake valve and exhaust valve camshaft phasers (dual independent cam phasing, DICP), it has been found that additional intake valve retard authority, amounting to about an additional 20 crankshaft degrees, can be highly beneficial in improving fuel economy under conditions of partial engine load. Prior art phasers are not capable of this beneficial extended authority.

What is needed in the art is an improved vane-type camshaft phaser having additional range of rotational authority in the retard direction, means for locking of the rotor to the stator at an intermediate locking position (ILP) comparable to the full-retard position of a prior art phaser, and a reliable oil supply (C3) separate from either C1 or C2.

It is a principal object of the present invention to improve fuel economy in an internal combustion engine.

It is a further object of the present invention to improve the reliability of locking pin action in a vane-type camshaft phaser.

SUMMARY OF THE INVENTION

Briefly described, a vane-type camshaft phaser in accordance with the invention for varying the timing of combustion valves in an internal combustion engine includes a rotor having a plurality of vanes disposed in a stator having a plurality of lobes, the interspersion of vanes and lobes defining a plurality of alternating valve timing advance and valve timing retard chambers with respect to the engine crankshaft. The rotational authority of the rotor within the stator with respect to top-dead-center of the crankshaft is between about 40 crank degrees before TDC (valve timing advanced) and about 30 crank degrees after TDC (valve timing retarded).

As in the prior art, it is generally desirable that an engine be started under an intake phaser position of about 10 crank degrees valve retard. Thus, an improved phaser in accordance with the present invention includes a seat formed in the stator at the appropriate position of intermediate rotation at about 10 crank degrees valve retard and a locking pin slidably disposed in a vane of the rotor for engaging the seat to lock the rotor at the intermediate position.

The locking pin assembly includes oil passages for actuating the locking pin in a preferred direction, which may be either to engage or to disengage the locking pin, and a bias spring for actuating the pin in a counter direction. In a presently preferred embodiment, the locking pin is defined as a third pressure chamber (C3) and is held in a disengaged position by the direct application of pressurized engine oil (C3 oil) independent of C1 and C2 oil used conventionally for advance and retard of the rotor. Preferably, C3 oil supply is controlled by a dedicated C3 control valve. The bias spring urges the locking pin into the seat when C3 pressure is removed from the pin.

Preferably, the seat and the ends of the locking pin are vented by appropriately-formed passages in the rotor and stator, which are aligned when the rotor is at the selected locking angle, to remove oil resistance to entry of the pin into the seat.

Preferably, the pin is cylindrical and the seat is square-sided to prevent accidental pin ejection from pressure variations in C1 and C2.

Because a negative gap is not available as a means for correctly positioning the locking pin over the seat, as in the prior art, the angular position of the rotor is sensed and the C1/C2 oil control valve is throttled to correctly position the locking pin prior to actuation thereof for engagement into the seat. Such throttling may include controlled phasing of the locking pin over the seat at a rate low enough to allow sufficient time for the locking pin motion to engage the seat.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
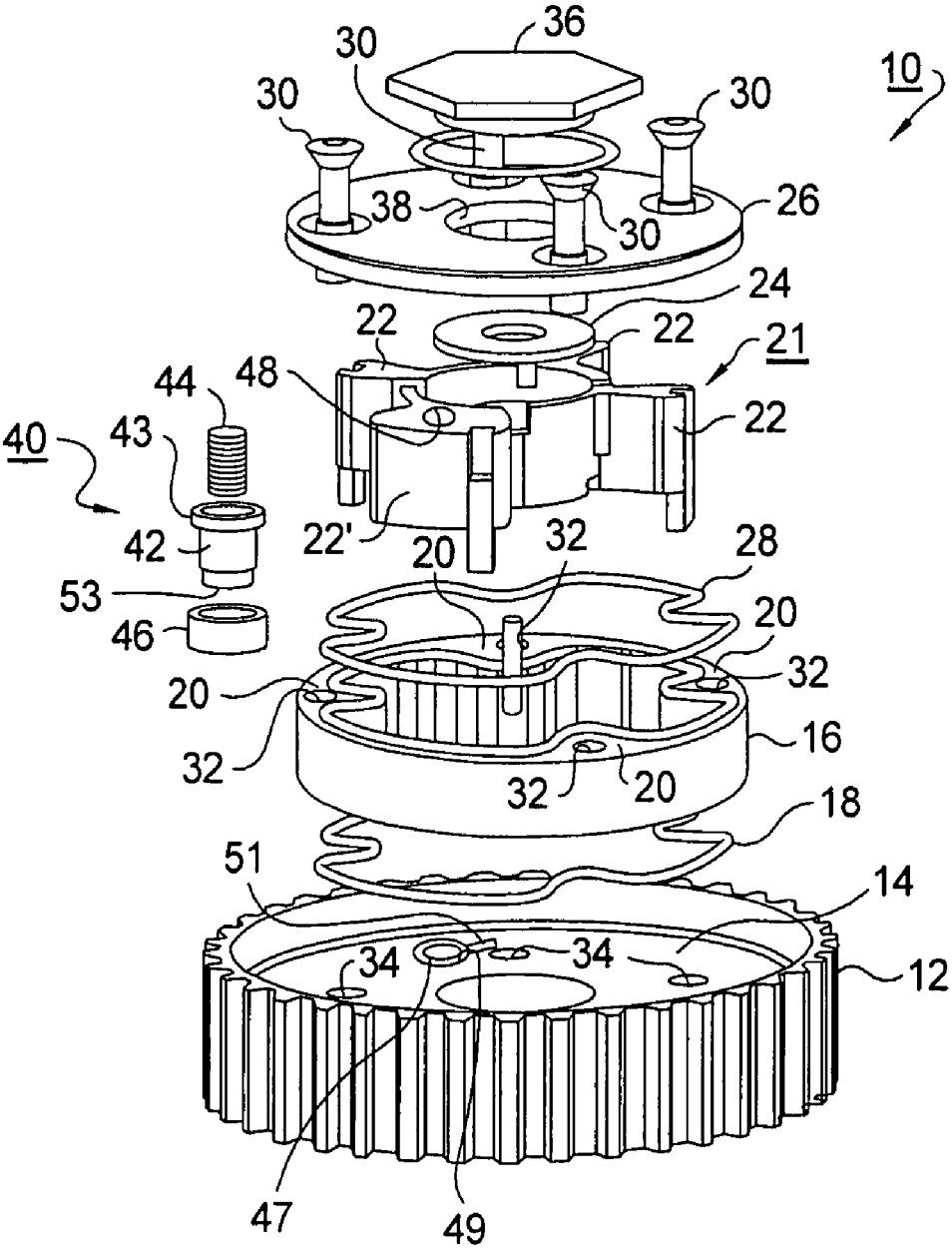
FIG. 1. (PRIOR ART)
FIG. 1 is an exploded isometric view of a prior art vane-type camshaft phaser, showing disposition of a locking pin and return spring in a rotor vane and a locking pin seat in the stator.

Referring to FIG. 1, a typical prior art vane-type cam phaser 10 includes a pulley or sprocket 12 for engaging a timing chain or belt (not shown) operated by an engine crankshaft (not shown). The upper surface 14 of pulley/sprocket 12 forms a first wall of a plurality of hydraulic chambers in the assembled phaser. A stator 16 is disposed against surface 14 and is sealed thereto by a first seal ring 18. Stator 16 is rotationally immobilized with respect to pulley/sprocket 12. Stator 16 is provided with a plurality of inwardly-extending lobes 20 circumferentially spaced apart for receiving a rotor 21 including outwardly extending vanes 22 which extend into the spaces between lobes 20. Hydraulic advance and retard chambers (not visible in exploded drawing) are thus formed between lobes 20 and vanes 22. A thrust washer 24 is concentrically disposed against rotor 21, and cover plate 26 seals against stator 16 via a second seal ring 28. Bolts 30 extend through bores 32 in stator 16 and are received in threaded bores 34 in pulley/sprocket 12, immobilizing the stator with respect to the pulley/sprocket. In installation to an engine camshaft, phaser 10 is secured via a central bolt (not shown) through thrust washer 24 which is covered by cover plug 36 which is threaded into bore 38 in cover plate 26.

A locking pin mechanism 40 comprises a hollow locking pin 42 having an annular shoulder 43, return spring 44, and bushing 46. Spring 44 is disposed inside pin 42, and bushing, pin, and spring are received in a longitudinal bore 48 formed in an oversize vane 22' of rotor 21, an end of pin 42 being extendable by spring 44 from the underside of the vane. A pin seat 47 is disposed in a well 49 formed in pulley/sprocket 12 for receiving an end portion of pin 42 when extended from bore 48 to rotationally lock rotor 21 to pulley/sprocket 12 and, hence, stator 16. The axial stroke of pin 42 is limited by interference of shoulder 43 with bushing 46. A shallow channel 51 formed in pulley/sprocket 12 extends from below seat 47 and intersects surface 14 in a region of that surface which forms a wall of a selected advance chamber in the assembled phaser. Thus, when oil (C1) is supplied to advance the rotor with respect to the stator, oil also flows through channel 51 to bring pressure to bear on the end surface (axial face) 53 of pin 42, causing the pin to be forced from seat 47 and thereby unlocking the rotor from the stator. Conversely, the pin defaults to the locked position whenever oil pressure is below a threshold level. In some instances it has been found that pressure build-up in the advance chamber, urging the rotor rotationally, causes pin 42 to become bound in seat 47 and to not be retracted in response to C1 oil pressure supplied through channel 51, as desired.

The rotational authority of prior art phaser 10 is between about 40° BTDC and about 10° ATDC. Well 49 and seat 47 are positioned in sprocket 12 such that rotor 21 is fully retarded and has a negative gap against a lobe 20 in stator 16 when locking pin 42 is engaged into seat 47.

Camshaft torque, valve train friction, and commanded pressure from the phaser oil control valve (not shown) drive the phaser to its extreme retarded position. As engine RPM decreases, the amount of time during which it is desirable for the phaser to remain at the fully retarded position increases. Thus, the window of time when the lock pin and seat are aligned also increases. Simultaneously, oil pressure within the phaser decreases as engine speed decreases. As C2 pressure on the lock pin decreases, the spring force urges the locking pin against the stator face. When the seat becomes aligned with the pin, and C2 pressure to the locking pin falls below a threshold amount, the pin accelerates into the seat and re-engagement occurs.

Figure 3:
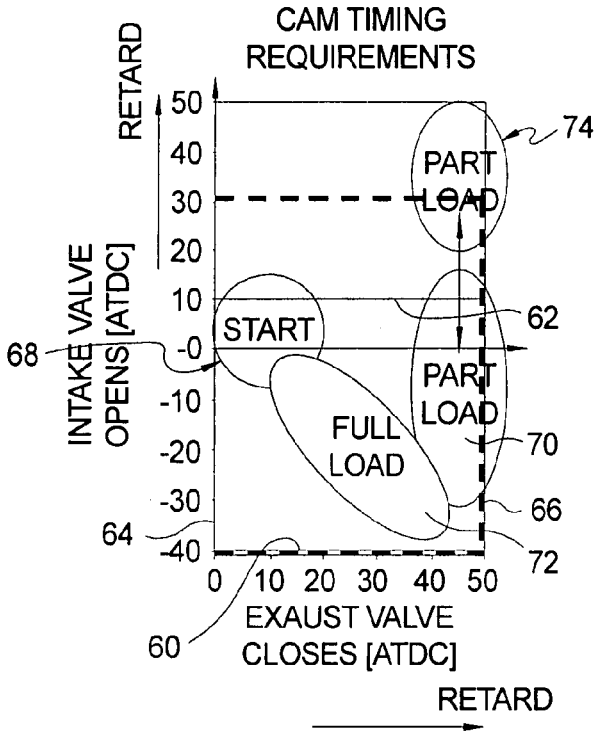
FIG. 3 is a graph of exhaust valve closing versus intake valve opening, expressed in crank angle degrees, showing various regions of engine operation.
Figure 4:
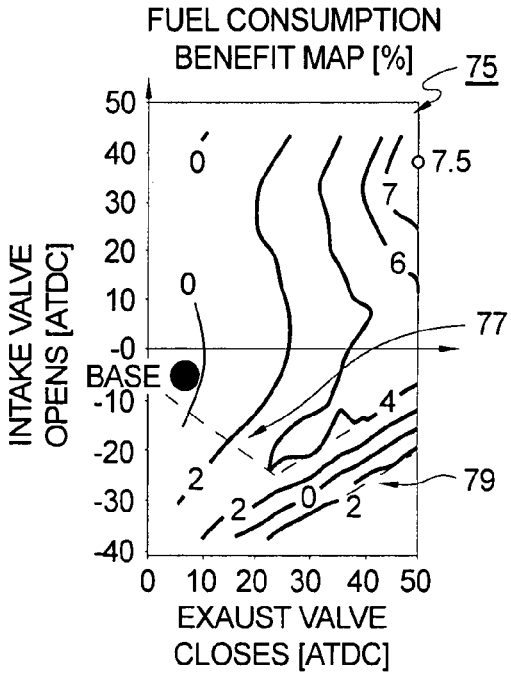
FIG. 4 is a graph like that shown in FIG. 3, showing isobars of improvement in engine fuel consumption achievable with independent camshaft phasing for both the intake and exhaust valves.

Referring to FIGS. 3 and 4, surprisingly it has been found that capability for additional rotor rotation in the valve retard direction can be beneficial, especially when both the intake valve camshaft and the exhaust valve camshaft in a dual camshaft engine are equipped with independently controllable phasers in accordance with the invention (the exhaust valve phaser may be a prior art phaser, whereas the intake valve phaser is improved in accordance with the invention). Referring to FIG. 3, the range of action permitted by a prior art intake valve phaser relative to crank TDC (0°) is from −40°(boundary 60) to +10° (boundary 62). The range of authority of a prior art exhaust valve phaser is from 0° (boundary 64) to +50° (boundary 66). It will be seen that these ranges cover acceptable engine operating regions for starting 68, prior art partial load 70, and full load 72. However, it has been found, in accordance with the present invention, that further retarding of the intake valves during improved partial engine load 74, for example, up to about 30° ATDC, can improve engine fuel efficiency significantly. Referring to FIG. 4 wherein the coordinates are the same as in FIG. 3, it is seen that the partial loading region 74 permitted by intake valve retarding up to 30° in accordance with the invention can provide fuel efficiency improvement of about 6 to 7 percent (region 75) in a test engine. Practical engine operating limits are also shown for knock (line 77) and combustion dilution (line 79).

Figure 2:
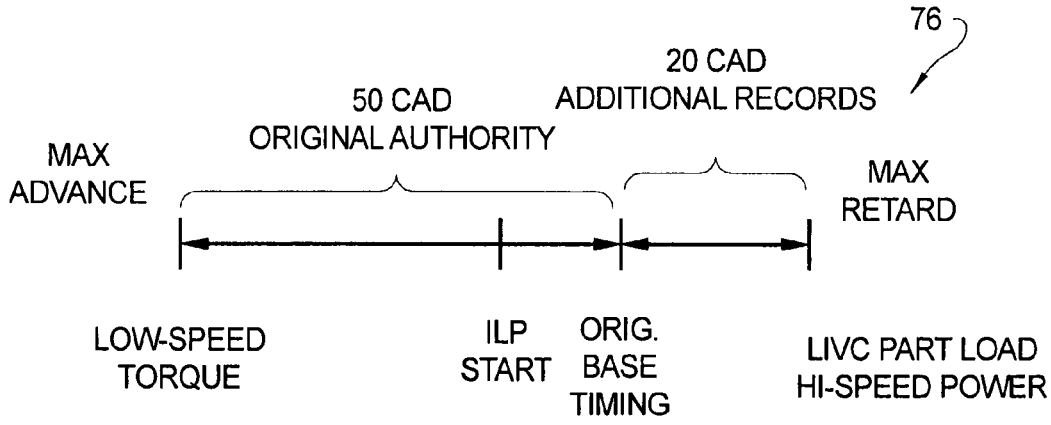
FIG. 2 is an exemplary phasing diagram for an engine equipped with an, improved intake valve phaser in accordance with the invention.

Referring to FIG. 2, an exemplary phasing diagram 76 shows the improvement afforded by the invention. The prior art 50 crank angle degrees for an intake valve phaser is augmented by an additional 20 crank angle degrees in the retard direction, permitting late intake valve closing (LIVC) of 30 degrees past TDC, permitting improved fuel consumption.

It is important that oil pressure actuating the locking pin be isolated from fluctuations in advance and retard pressures (C1,C2) experienced by prior art phaser 10 wherein the pin actuation pressure is parasitic upon the adjacent advance chamber pressure via passage 51. Referring to FIGS. 5 through 8 and 14, in first and second embodiments 100, 200 of an improved camshaft phaser in accordance with the invention, an independent oil supply, shown as C3, is provided to the phaser via an independent longitudinal gallery 102 formed in camshaft 104, which is supplied with engine oil (as described further below) via a rotating coupling at groove 106 in known fashion. Cam gallery 102 mates with a longitudinal gallery 108 formed in hub 110 of rotor 112.

Figure 5:
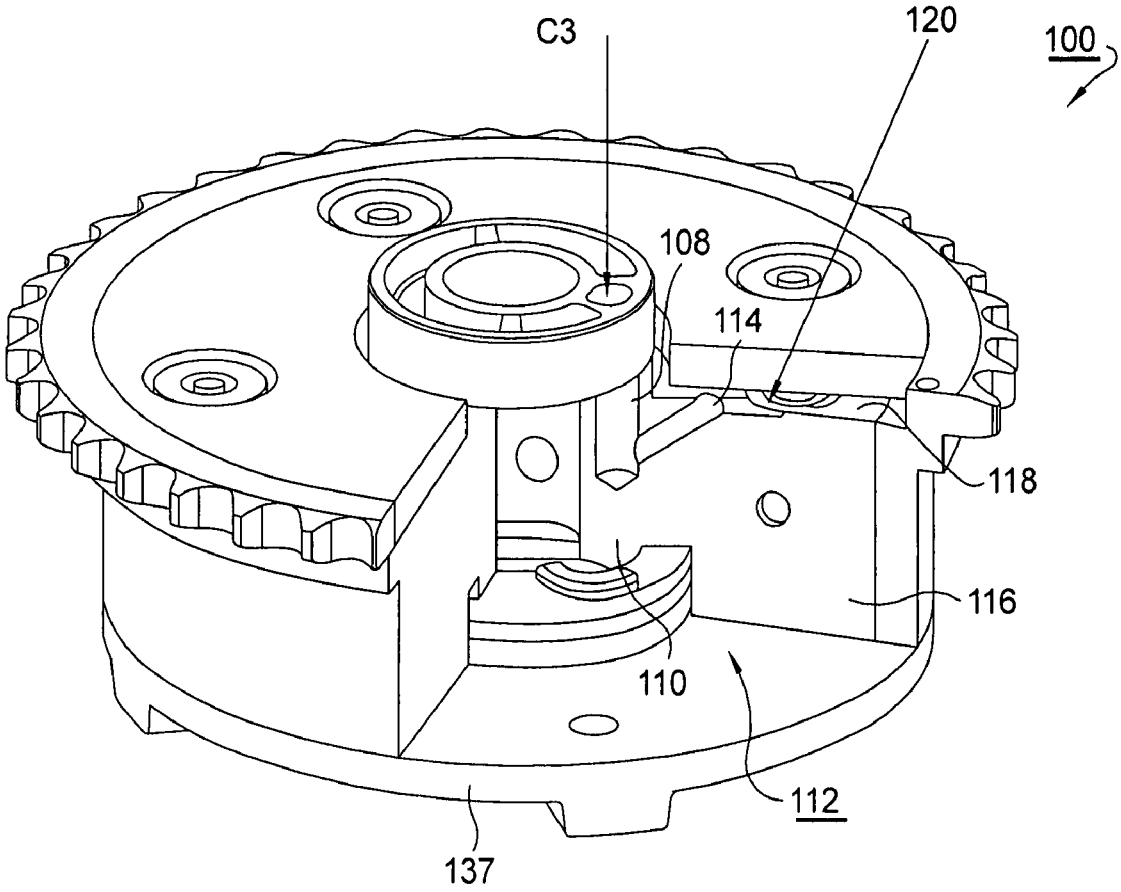
FIG. 5 is a cutaway isometric view of a first embodiment of a camshaft phaser in accordance with the invention, showing a dedicated C3 oil path to cause engagement of a locking pin into a stator seat.

Referring to FIG. 5, in first embodiment 100, a passage 114 within rotor vane 116 extends diagonally from gallery 108 to the surface 118 of vane 116 adjacent the outer end 120 of a locking pin and internal coil spring (not visible in FIG. 5). When C3 oil is provided to pin end 120 via passage 114, the pin is urged into seat 136 in stator 137 ("oil pressure to lock, spring to unlock"). Although within the scope of the invention, embodiment 100 is not presently preferred because continuous locking requires a continuous supply of C3 oil greater. The rotor will unlock spontaneously when the engine is shut down.

Figure 6:
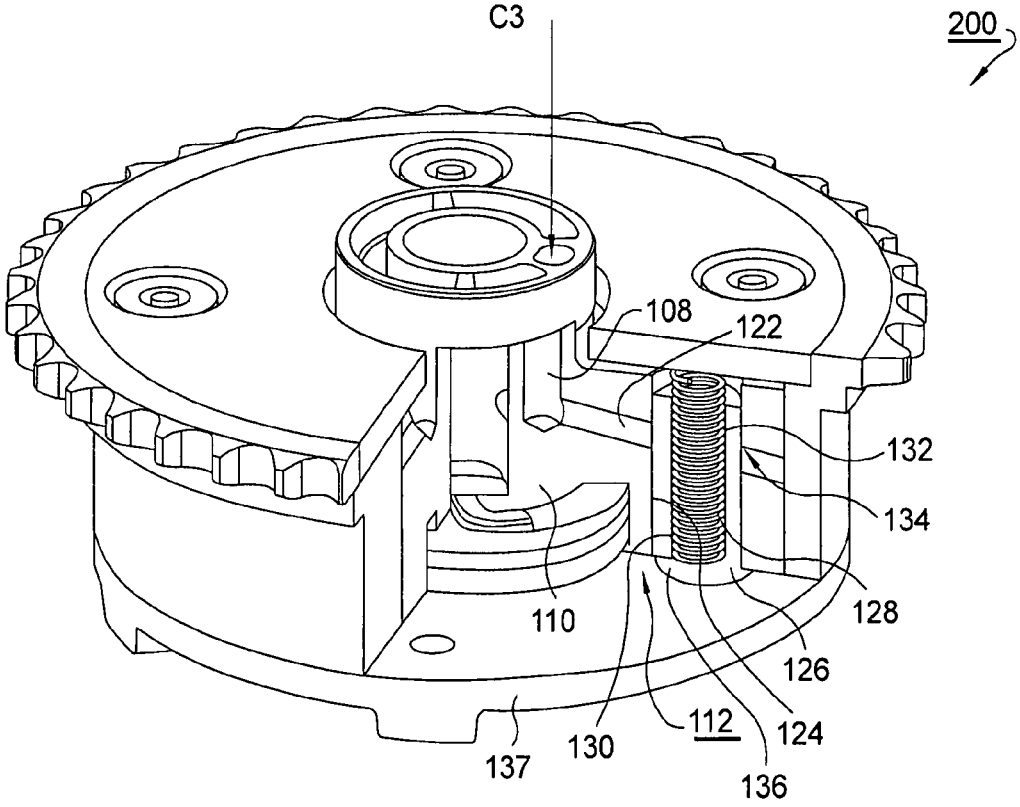
FIG. 6 is a cutaway isometric view of a second embodiment of a camshaft phaser in accordance with the invention, showing a dedicated C3 oil path to cause dis-engagement of a locking pin into a stator seat.
Figure 8:
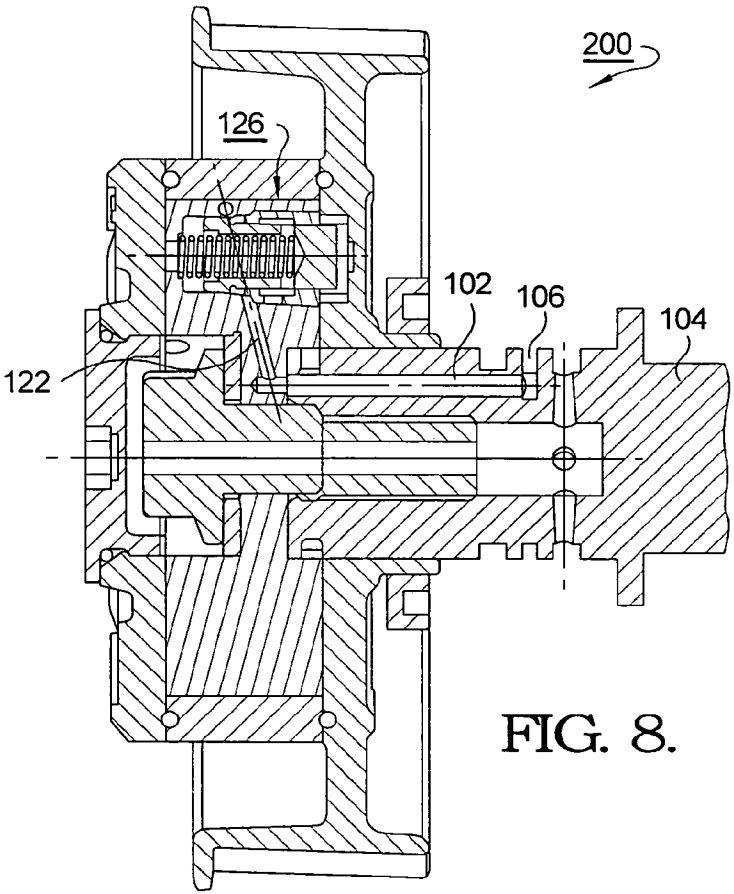
FIG. 8 is an axial cross-sectional view taken through the second embodiment shown in FIG. 6, showing the locking pin in engaged mode by removal of C3 oil pressure
Figure 7:
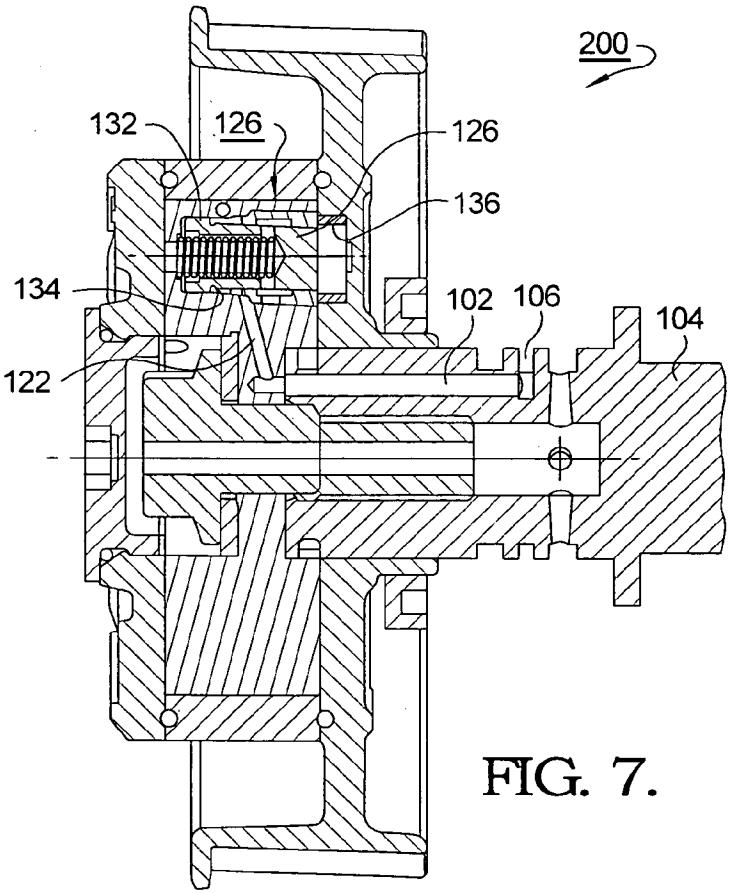
FIG. 7 is an axial cross-sectional view taken through the second embodiment shown in FIG. 6, showing the locking pin in disengaged mode by C3 oil pressure.

Referring to FIGS. 6 through 8, in second and currently-preferred embodiment 200, longitudinal gallery 108 is radially intersected by passage 122 extending through a bore 124 in a rotor vane slidably supportive of locking pin 126 and internal return spring 128. Locking pin 126 has a first diameter over the locking portion 130 thereof, and a larger second diameter over an actuating portion 132 thereof, there being a shoulder 134 therebetween. Likewise bore 124 is shouldered to be full-fitting to both first and second pin portions 130,132. Thus, C3 oil provided via passage 122 acts upon shoulder 134 to urge pin 126 from stator seat 136, as shown in FIG. 7 ("oil pressure to unlock, spring to lock"). Locked position is shown in FIG. 8.

Note that in both improved embodiments 100,200, the phasing action of the rotor within the phaser is controlled conventionally by independent C1 and C2 oil supplies (not shown) as in prior art phaser 10. The invention is directed to providing a separate, independent C3 oil supply for actuation of the locking pin.

Embodiment 200 is presently preferred over embodiment 100 because continuous locking does not require a continuous supply of C3 oil. Being locked by removal of C3 oil pressure and force of return spring 128, the rotor remains locked to the stator when the engine is shut down, and thus, the rotor is locked to the stator in a preferred and known angular location when the engine is first cranked. A presently preferred locking location for an intermediate locking pin (ILP) in accordance with the invention is at about TDC, as shown in FIGS. 2 and 3.

Figure 10:
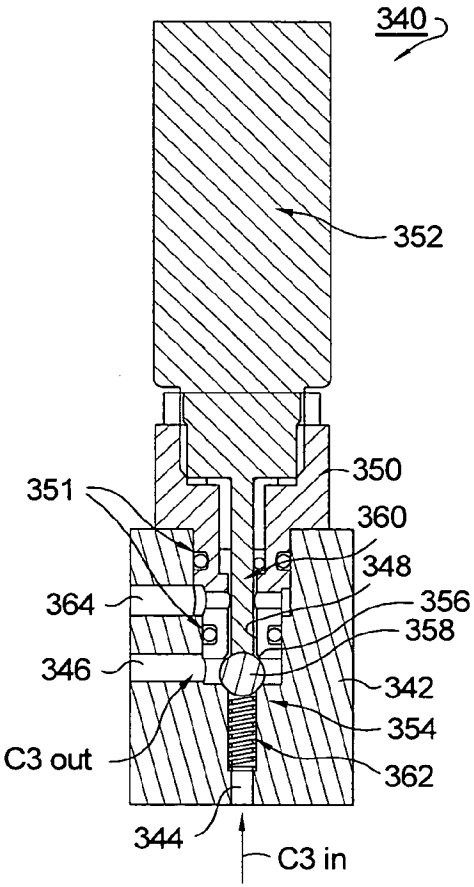
FIG. 10 is a cross-sectional elevational view of a solenoid valve assembly for regulating flow of C3 oil in either of the embodiments shown in FIGS. 5 and 6.
Figure 9:
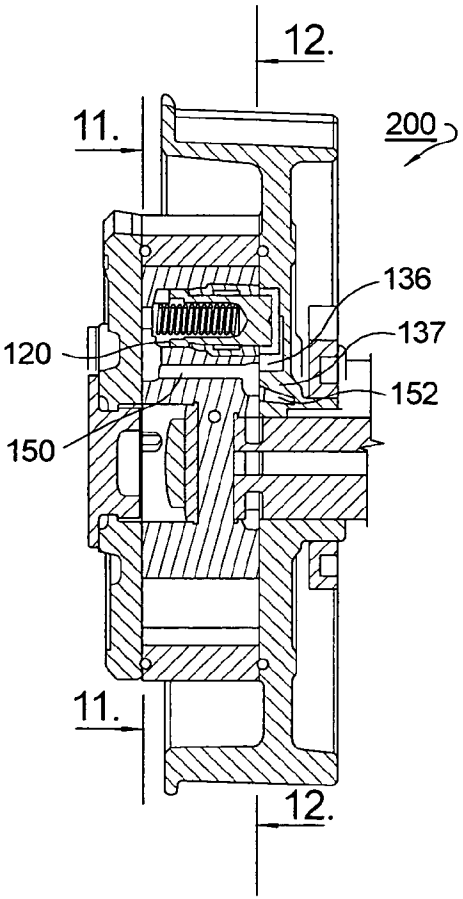
FIG. 9 is an axial cross-sectional view taken through the second embodiment shown in FIG. 6, showing vent paths for venting pressure from both the top of the locking pin and the seat in the stator.

Referring to FIG. 10, an oil control valve (OCV) 340 for controlling the supply of C3 oil to either of embodiments 100,200 is shown configured for use with embodiment 200. OCV 340 comprises a valve body 342 having an entry passage 344 for C3 oil supplied by an oil supply source (not shown), such as an engine oil pump. Passage 344 is intersected by an exit passage 346 for supplying C3 oil to camshaft gallery 102 (FIG. 8). Passage 344 is coaxial with and extensive of passage 348 formed in a mounting block 350 for a solenoid actuator 352, which is sealed into valve body 342 by seals 351. Passage 344 terminates in a beveled supply seat 354, and passage 348 terminates in an opposing beveled supply seat 356. A ball 358 is disposed therebetween at the intersection of passages 344,346 for closing against either of seats 354, 356 as desired but not against both simultaneously. An actuating plunger 360 extending from solenoid actuator 352 engages ball 358 and is opposed by spring 362 in passage 344. A vent passage 364 in the valve body and mounting block communicates with passage 346 via passage 348 and seat 356.

In operation, when solenoid is activated, as shown in FIG. 10, ball 358 closes off supply of C3 oil and simultaneously opens a vent path from C3 outlet 346 through vent 364. Conversely, when solenoid 352 is deactivated, spring 362 urges ball 358 off of seat 354, permitting flow of C3 oil to gallery 102 to unlock pin 126 as shown in FIG. 8. Thus, during normal engine operation, lock pin is maintained in an unlocked position by engine oil pressure, and solenoid actuation is not required. When the engine is shut down, solenoid 352 remains deactivated, but C3 goes to zero pressure, allowing pin 126 to lock into seat 136.

For embodiment 100, the valve logic is simply reversed.

Preferably, locking pin 126 is cylindrical and seat 136 is square-sided such that there is no vector to assist in urging the pin from the seat in response to any stray pressure pulses, and further to assure that the pin remains in locked mode if only partially inserted into seat 136.

Because the motion of the lock pin in the direction opposite to C3 pressure is solely in response to compression (embodiment 200) or extension (embodiment 100) of spring 128, care should be taken to assure that rapid motion of the pin is not impeded by residual oil in seat 136 and against shoulder 134. Therefore, an active oil vent path is preferably provided.

Referring to FIGS. 9 and 11-13, a first vent passage 150 extends axially of the rotor hub in communication with first end 120 of locking pin 126. When the rotor is in position for locking engagement to stator seat 136, first passage 150 is aligned and communicates with both seat 136 and a second vent passage 152 formed in stator 137 which leads to the engine sump at atmospheric pressure. Thus, at the predetermined locking position, solenoid 352 is energized, driving ball 358 against seat 354, shutting off the supply of C3 oil to the phaser and simultaneously opening a return vent path through OCV 340 to the engine sump via vent port 364. C3 pressure is atmospheric at this point, and thus spring 128 encounters minimal resistance in urging pin 126 into seat 136.

In an alternative venting scheme (not shown), a vent port in the rotor leads to the bottom of the seat. As the rotor aligns the locking pin with the seat, this vent path opens and allows the oil pressure at the end face of the locking pin to come to atmospheric, allowing the locking pin to move freely into the seat. This venting scheme eliminates parasitic oil losses that can occur through vent port 152 when stator opening 158 is uncovered during operational rotation of the rotor.

Figure 12:
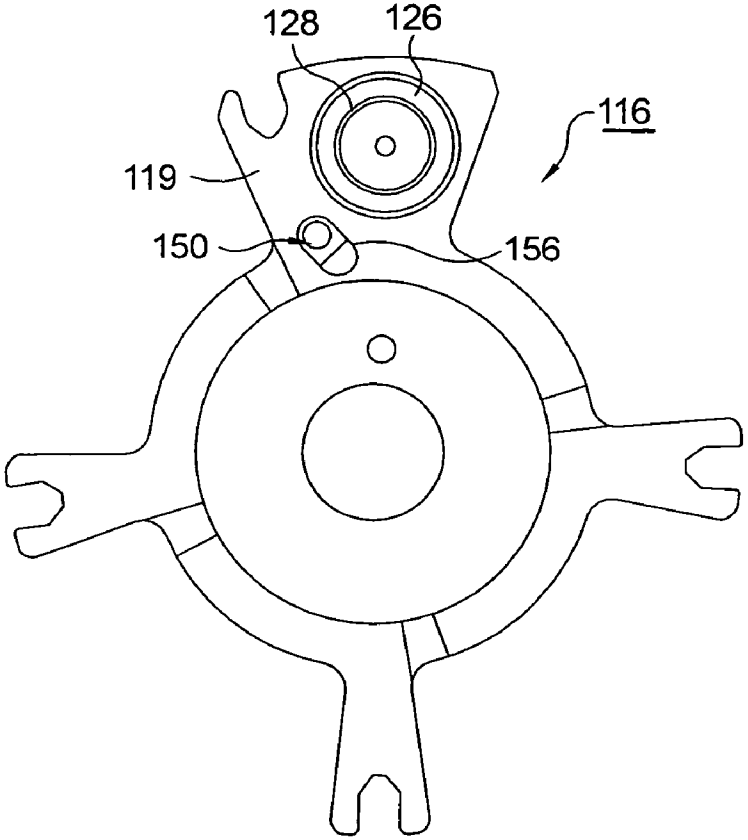
FIG. 12 is a plan view taken along line 12-12 in FIG. 9, showing an inner (toward engine) surface of the rotor and pressure relief porting for mating with porting in the stator.
Figure 11:
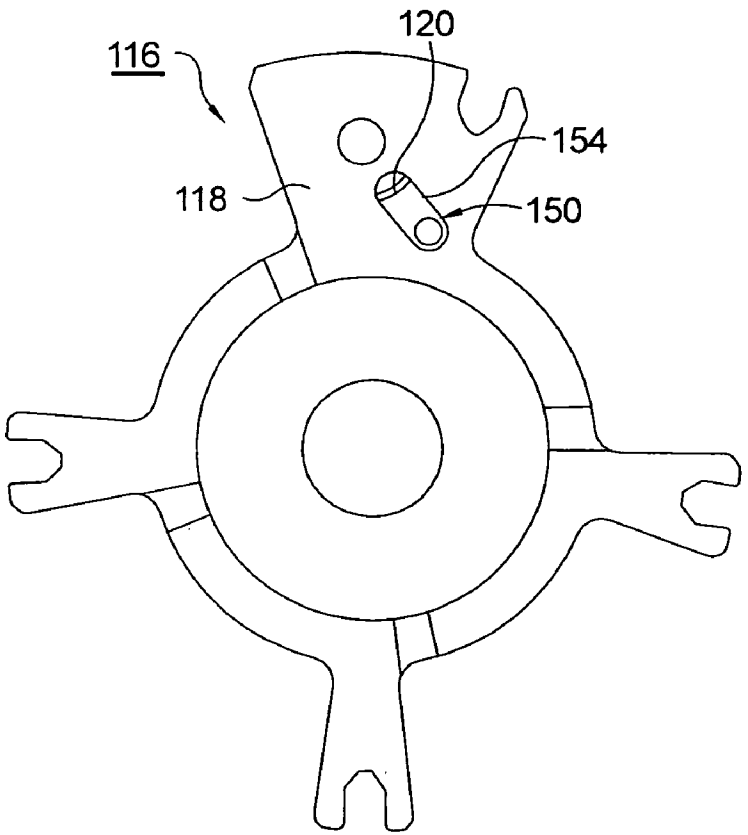
FIG. 11 is a plan view taken along line 11 in FIG. 9, showing an outer (away from engine) surface of the rotor and showing pressure relief porting extending therethrough.
Figure 14:
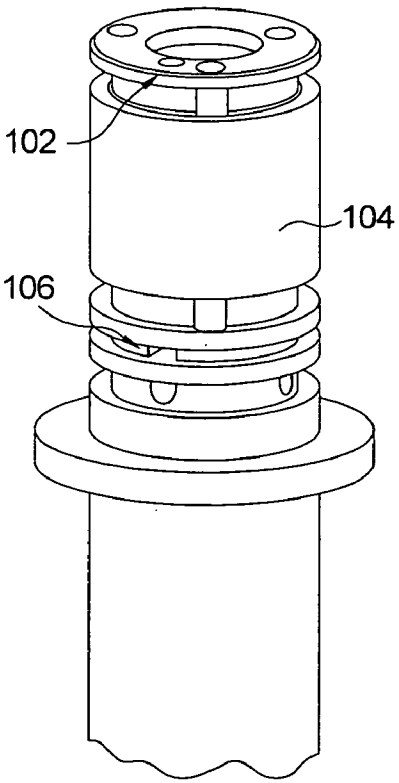
FIG. 14 is an isometric view of the end of the camshaft shown in FIGS. 7-9, showing C3 porting therein.
Figure 13:
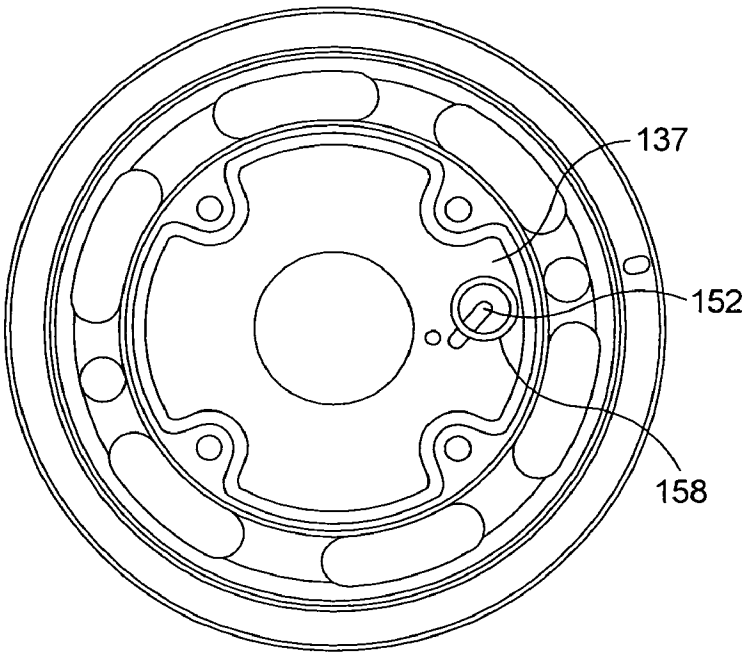
FIG. 13 is a plan view of the rotor-mating surface of the stator, showing relief porting for mating with the porting shown in FIGS. 11 and 12.

Referring to FIGS. 11-13, first vent passage 150 is visible through an elongate opening 154 in outer surface 118 of rotor 116 in communication with pin end 120, as well as through an elongate opening 156 in inner surface 119 of rotor 116. Opening 156 mates with an opening 158 in the surface of stator 137 in communication with passage 152.

Recall that the lock pin has no negative gap reference for alignment with the stator seat as in the prior art, as the rotor is at a rotary position intermediate between fully advanced and fully retarded when locked. In unlocked phasing mode when the rotor is being commanded to various angular positions by an engine control module in response to present and/or anticipated engine operating condition, the rotor angular phasing rate is preferably as high as possible, given the mechanical and hydraulic limitations of the system. However, when locking re-engagement is required, the locking pin must adequately align with its seat with sufficient time for re-engagement to occur. When the locking pin is within a predetermined rotational phase angle of the locking pin seat, preferably within about +/−3 degrees, the rotational phasing rate of the rotor is reduced to sweep the locking pin over the seat in a controlled motion at the reduced rotational rate. Minor instability is acceptable as there are preferably about 3 total degrees of lash between the pin and the seat to ease tolerances and to aid in re-engagement. Thus independent control of the phase angle, via a computerized engine control module (not shown) and the C1/C2 OCV, are preferred for successful, reliable re-engagement.

Strategies for re-engagement of the lock pin at lower phasing rate may include:

1) positioning the phase angle slightly advanced (3 degrees) of the lock position, commanding the phaser C1/C2 OCV to hold position, and allowing minor internal leakage resulting from camshaft torque to naturally "drift" the phase angle in the retard angle direction producing a slow alignment of the locking pin and seat; or 2) commanding either an advancement or retardation of phase angle (depending of which side of absolute alignment between the pin and seat) with a proper duty cycle of the phaser OCV to produce an acceptable relative velocity between the rotor and stator that allows adequate time for locking pin re-engagement.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for advancing and retarding the timing of valves in an internal combustion engine, comprising:

a) a stator having a plurality of lobes;

b) a rotor disposed within said stator and having a plurality of vanes interspersed with said plurality of lobes, wherein said rotor has a range of rotational authority of about 70 angular degrees;

c) a locking pin slidably disposed in one of said rotor and said stator, said locking pin having first and second ends;

d) a seat formed in the other of said rotor and said stator for selectively receiving said second end of said locking pin to secure said rotor against rotation within said stator in a locking position;

e) a spring disposed adjacent said locking pin for urging said locking pin in a predetermined spring-urging direction with respect to said seat;

f) an oil supply passage in communication with said locking pin for selectively urging said locking pin in an oil-urging direction opposite to said spring-urging direction; and g) a first vent passage in communication with said first end of said locking pin and an engine sump when said camshaft phaser is in said locking position, wherein said first vent passage communicates with said seat when said camshaft phaser is in said locking position.

2. A camshaft phaser in accordance with claim 1 wherein said engine sump is at atmospheric pressure.

3. A camshaft phaser in accordance with claim 1 wherein said rotor includes a hub, and wherein said first vent passage extends axially relative to said hub.

4. A camshaft phaser in accordance with claim 1 further comprising a first elongate opening defined in said rotor, wherein said first elongate opening is in communication with said first end of said locking pin and said first vent passage.

5. A camshaft phaser in accordance with claim 4 wherein said first elongate opening is defined in an outer surface said rotor.

6. A camshaft phaser in accordance with claim 1 wherein said locking pin is a hollow locking pin.

7. A camshaft phaser for advancing and retarding the timing of valves in an internal combustion engine, comprising:

a) a stator having a plurality of lobes;

b) a rotor disposed within said stator and having a plurality of vanes interspersed with said plurality of lobes, wherein said rotor has a range of rotational authority of about 70 angular degrees;

c) a locking pin slidably disposed in one of said rotor and said stator, said locking pin having first and second ends;

d) a seat formed in the other of said rotor and said stator for selectively receiving said second end of said locking pin to secure said rotor against rotation within said stator in a locking position;

e) a spring disposed adjacent said locking pin for urging said locking pin in a predetermined spring-urging direction with respect to said seat;

f) an oil supply passage in communication with said locking pin for selectively urging said locking pin in an oil-urging direction opposite to said spring-urging direction;

g) a first vent passage in communication with said first end of said locking pin and an engine sump when said camshaft phaser is in said locking position; and h) a second vent passage formed in said stator, wherein said first vent passage communicates with said second vent passage when said camshaft phaser is in said locking position, and wherein said second vent passage is in communication with said engine sump.

8. A camshaft phaser in accordance with claim 7 wherein said engine sump is at atmospheric pressure.

9. A camshaft phaser in accordance with claim 7 further comprising a first elongate opening defined in said rotor, wherein said first elongate opening is in communication with said first end of said locking pin and said first vent passage.

10. A camshaft phaser in accordance with claim 9 wherein said first elongate opening is defined in an outer surface said rotor.

11. A camshaft phaser in accordance with claim 9 further comprising a second elongate opening defined in said rotor, wherein said second elongate opening is in communication with said first vent passage and said second vent passage.

12. A camshaft phaser in accordance with claim 11 wherein said second elongate opening is defined in an inner surface said rotor.

13. A camshaft phaser for advancing and retarding the timing of valves in an internal combustion engine, comprising:

a) a stator having a plurality of lobes;

b) a rotor disposed within said stator and having a plurality of vanes interspersed with said plurality of lobes;

c) a locking pin slidably disposed in one of said rotor and said stator, said locking pin having first and second ends;

d) a seat formed in the other of said rotor and said stator for selectively receiving said second end of said locking pin to secure said rotor against rotation within said stator in a locking position;

e) a spring disposed adjacent said locking pin for urging said locking pin in a predetermined spring-urging direction with respect to said seat;

f) an oil supply passage in communication with said locking pin for selectively urging said locking pin in an oil-urging direction opposite to said spring-urging direction; and g) a first vent passage in communication with said first end of said locking pin and an engine sump when said camshaft phaser is in said locking position, wherein said first vent passage communicates with said seat when said camshaft phaser is in said locking position.

* * * * *